US005251835A

United States Patent [19]

Kyytsönen

[11] Patent Number: 5,251,835

[45] Date of Patent: Oct. 12, 1993

[54] REEL-UP AND A METHOD OF REELING

[75] Inventor: Markku Kyytsönen, Numminen, Finland

[73] Assignee: Valmet Paper Machinery Inc., Helsinki, Finland

[21] Appl. No.: 781,490

[22] Filed: Oct. 22, 1991

[30] Foreign Application Priority Data

Oct. 26, 1990 [FI] Finland ..... 905284

[51] Int. Cl.[5] ..... B65H 18/16

[52] U.S. Cl. ..... 242/65

[58] Field of Search ..... 242/65, 56 R

[56] References Cited

U.S. PATENT DOCUMENTS

| | | | |
|---|---|---|---|
| 3,258,217 | 6/1966 | MacArthur et al. | 242/65 |
| 3,471,097 | 10/1969 | Phelps | 242/56 R |
| 3,743,199 | 7/1973 | Karr et al. | 242/65 |
| 3,857,524 | 12/1974 | Melead et al. | 242/56 R |
| 4,179,330 | 12/1979 | Page | 242/65 X |
| 4,934,619 | 6/1990 | Snygg | 242/56 R |
| 4,944,467 | 7/1990 | Snygg | 242/65 |

FOREIGN PATENT DOCUMENTS

| | | |
|---|---|---|
| 0330169 | 2/1989 | European Pat. Off. . |
| 0350212 | 6/1989 | European Pat. Off. . |
| 1101938 | 3/1961 | Fed. Rep. of Germany . |
| 3212960 | 10/1983 | Fed. Rep. of Germany . |
| 244323 | 4/1987 | German Democratic Rep. . |
| 2012733 | 8/1979 | United Kingdom . |

*Primary Examiner*—Daniel P. Stodola
*Assistant Examiner*—John P. Darling
*Attorney, Agent, or Firm*—Smith-Hill & Bedell

[57] ABSTRACT

A web is reeled onto successive reeling drums to form respective jumbo rolls by reeling the web onto a first reeling drum at a reeling position to form a first jumbo roll, the first reeling drum being driven by a center drive. When the first jumbo roll is full, a second reeling drum is delivered to a standby position and is accelerated to web speed. A transfer device is employed to transfer the first jumbo roll to an exchange position while the center drive remains connected thereto. The second reeling drum is transferred to the reeling position and the web is exchanged from the first jumbo roll to the second reeling drum. The first jumbo roll is decelerated and the transfer device is shifted from the first jumbo roll to the second reeling drum. The center drive is connected to the second reeling drum.

3 Claims, 3 Drawing Sheets

REEL-UP AND A METHOD OF REELING

BACKGROUND OF THE INVENTION

This invention relates to a reel-up and a method of reeling.

A known type of reel-up comprises a reeling cylinder or first revolving roll supported stationarily in a frame and a reeling drum or second revolving roll supported on reeling rails or equivalent. The first and second revolving rolls together form a nip. The web passes around the first revolving roll and through the nip, and is reeled onto the second revolving roll.

In reeling, for example in Pope-type reeling, the reeling drum is initially supported on primary reeling forks and is subsequently transferred to secondary reeling forks, and the exchange of the reeling drum from the primary forks onto the secondary forks causes discontinuity in the reeling of the web, with resulting broke in the paper roll bottom, i.e. the paper layers closest to the reel spool. Therefore it would be desirable to eliminate the need to transfer the reeling drum from the primary forks to the secondary forks and that the initial stage especially of the reeling should take place in a standardized situation.

SUMMARY OF THE INVENTION

The object of the invention is to provide a solution for the above problems in the exchange in reeling. A further object of the invention is to improve the structure of the roll.

In accordance with a first aspect of the invention there is provided a method of reeling a web onto successive reeling drums to form respective jumbo rolls, said method comprising reeling the web onto a first reeling drum at a reeling position to form a first jumbo roll, the first reeling drum being driven by center drive means, when the first jumbo roll is full, delivering a second reeling drum to a standby position and accelerating the second reeling drum to web speed, employing a transfer device to transfer the first jumbo roll to an exchange position while the center drive means remain connected thereto, transferring the second reeling drum to he reeling position, exchanging the web from the first reeling drum to the second reeling drum, decelerating the first jumbo roll, shifting the transfer device from the first jumbo roll to the second reeling drum, and connecting the center drive means to the second reeling drum.

In accordance with a second aspect of the invention there is provided a method of reeling a web onto successive reeling drums to form respective jumbo rolls, said method comprising reeling the web onto a first reeling drum at a reeling position to form a first jumbo roll, the first jumbo roll being driven by a first center drive, when the first jumbo roll is full, delivering a second reeling drum to a standby position, connecting a second center drive to the second reeling drum, and accelerating the second reeling drum to web speed, employing a first support and transfer device to transfer the first jumbo roll to an exchange position while the first center drive remains connected thereto, employing a second support and transfer device to transfer the second reeling drum, having the second center drive connected thereto, to the reeling position, decelerating the first jumbo roll, and reeling the web onto the second reeling drum to form a second jumbo roll and positioning the first support and transfer device to receive a third reeling drum at the standby position.

In accordance with a third aspect of the invention there is provided a reel-up comprising a reeling cylinder, means for supporting a reeling drum at a reeling position relative to the reeling cylinder so that the reeling cylinder and reeling drum form a nip for receiving a web being reeled onto the reeling drum, center drum means for driving the reeling drum at the reeling position, transfer means for moving the reeling drum from the reeling position to an exchange position, and transfer means for bringing a second reeling drum to the reeling position.

In accordance with a fourth aspect of the invention, there is provided a reel-up comprising a reeling cylinder, means for supporting a reeling drum in a reeling position relative to the reeling cylinder so that the reeling drum and the reeling cylinder form a nip for receiving a web being reeled onto the reeling drum, a first support and transfer device for supporting a first reeling drum at the reeling position and for transferring the first reeling drum to an exchange position, and a second support and transfer device for receiving a second reeling drum when the first reeling drum is at the exchange position and delivering the second reeling drum to the reeling position.

According to the invention, when the jumbo roll that has been formed on the rails is almost full, a new reeling drum is brought by means of transfer members, such as auxiliary forks or equivalent, to the exchange position and is accelerated to the web speed. The reeling-drum transfer device, which is attached to the rails and synchronized between the operating side and the driving side, transfers the reeling drum, which is connected to the center drive, to the exchange position. The necessary tension of the web is produced by means of a torque at the roll center. The new, pre-accelerated reeling drum is lowered onto the rails, and the excange of the web from the completed jumbo roll to the new reeling drum is carried out by means of normal prior art methods, such as bag exchange and side blowings or equivalent. Hereupon, the full jumbo roll is slowed down and the reeling-drum transfer sledges are brought to the new reeling drum, and the center drive is transferred to the new reeling drum.

When a full jumbo roll is separated from the face of the reeling cylinder, there is no nip contact. In such a case, air tends to enter into the jumbo roll through the gap between the full jumbo roll and the arriving web, causing possible deterioration of the quality of the jumbo roll. In the solution in accordance with the invention, this can be prevented by, before the transfer of the jumbo roll, creating an additional nip, which is placed preferably at the point at which the arriving web meets the mantle of the jumbo roll. This additional nip prevents access of air into the jumbo roll.

BRIEF DESCRIPTION OF THE DRAWINGS

In the following, the invention will be described in more detail with reference to the figures in the accompanying drawings, the invention being, however, not supposed to be confined strictly to the illustrations in said figures. In the drawings.

DETAILED DESCRIPTION

Figure 1:
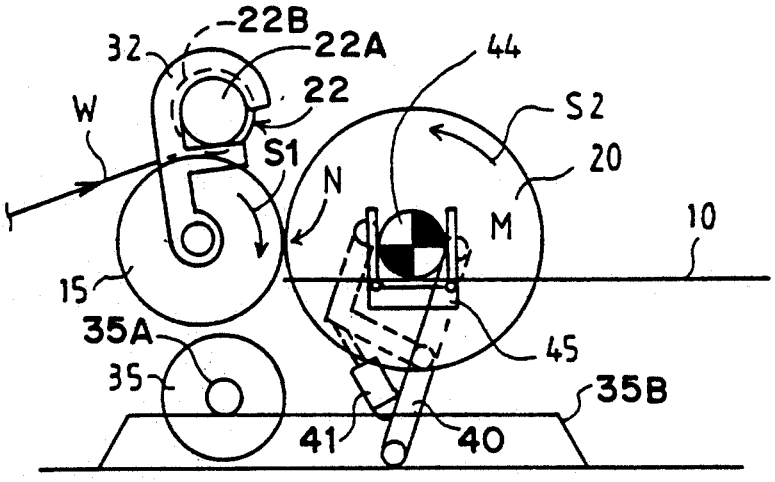
FIG. 1 is a schematic illustration of a reeling arrangement in accordance with the invention at the stage at which the new reeling drum is brought into the standby position.

The reel-up shown in FIG. 1 comprises a reeling cylinder 15 and a reeling drum 20, both of which are revolving and which form a nip N. The reeling cylinder 15 is driven to rotate, e.g. by a motor (not shown) in the direction indicated by the arrow S1. The reeling drum 20 is mounted on rails 10, and it is connected to a center drive 44, such as an electric or hydraulic motor, and to a reeling-drum transfer device 45. In the reel-up shown in FIG. 1 a web W, e.g. of paper, is fed over the first roll, i.e. the reeling cylinder 15, and passes through the nip N and is reeled onto the second revolving roll, i.e. the reeling drum 20.

By means of a support device 40 and a cylinder 41, it is ensured that the reeling drum or the roll formed thereon is held in contact with the reeling cylinder and that the reeling drum 20 does not vibrate during reeling. The jumbo roll 20 is almost full and, by means of the transfer members or forks 32, a new reeling drum 22 has been brought to the standby position. The transfer members 32 grip the bearing housing 22A of the new reeling drum 22, while the reel spool mantle 22B of the new reeling drum extends between the transfer members. A press roll 35 is in a standby position in proximity to the jumbo roll 20. The press roll has an axle 35A by which the press roll is supported on rails 35B. One jaw of each auxiliary fork is movable to allow the auxiliary forks to open and release the new reeling drum and to receive a further reeling drum.

Figure 2:
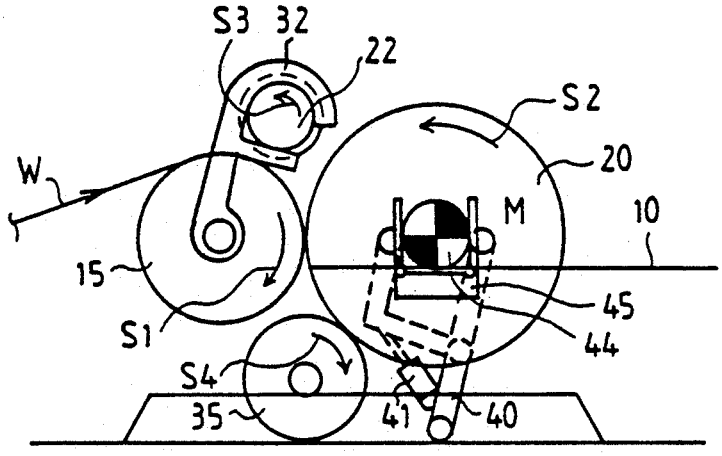
FIG. 2 is a schematic illustration of the reeling arrangement at the stage at which the new reeling drum is accelerated to the web speed.

At the stage shown in FIG. 2, the jumbo roll 20 formed on the rails 10 is almost full. When the jumbo roll 20 is full, the new reeling drum 22 is brought, by means of auxiliary forks or equivalent transfer members 32, to the standby position, and the new reeling drum 22 is accelerated to the web speed. The press roll 35 has been accelerated by means of a motor (not shown) and has been shifted along the rails 35B into contact with the jumbo roll 20 to create an additional nip so as to prevent access of air into the jumbo roll 20. The press roll 35 is brought into contact with the jumbo roll 20 before the jumbo roll 20 is separated from the reeling cylinder 15.

Figure 3:
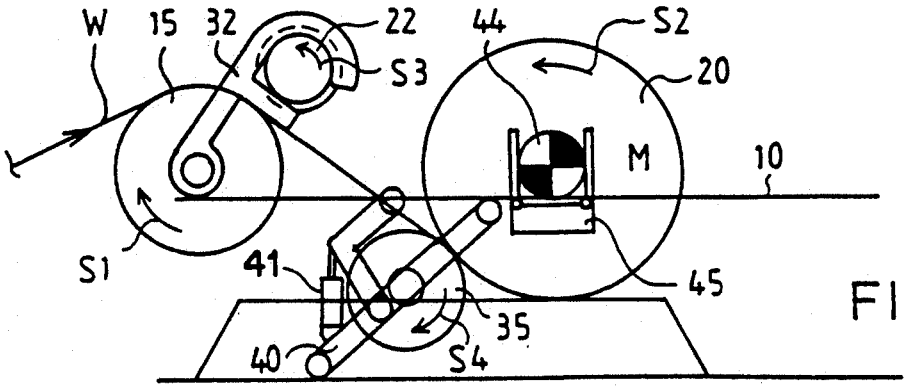
FIG. 3 is a schematic illustration of the reeling arrangement at the stage at which the full jumbo roll is transferred to the exchange position.

As shown in FIG. 3, the reeling drum 20 transfer device 45, which is mounted on the rails 10 and synchronized between the operating (or tending) side of the paper machine and the driving side thereof, transfers the jumbo roll 20, which is connected to the center drive 44, to the exchange position. The necessary tension of the web is provided by means of a torque M produced at the roll center by the center drive 44. The support device 40 with its cylinder 41 is separated from engagement with the jumbo roll 20 and is returned to its position ready to receive a new reeling drum 22, which is transferred onto the rails 10 by means of transfer members, e.g. auxiliary forks 32.

Figure 4:
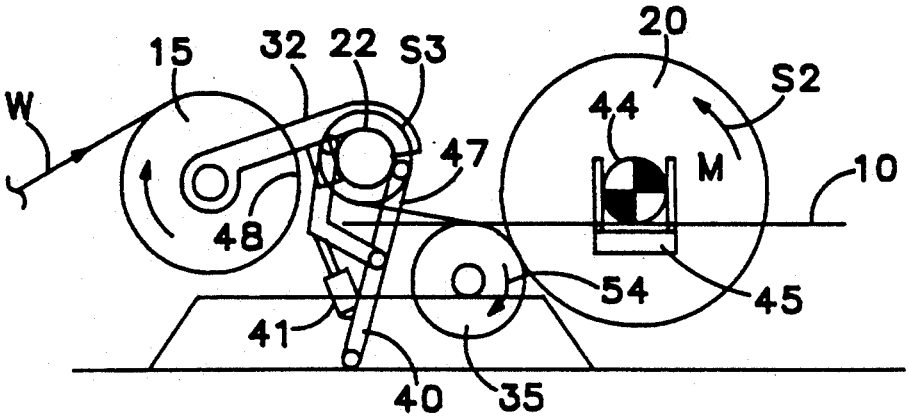
FIG. 4 is a schematic illustration of the reeling arrangement at the stage at which the new reeling drum is connected to the web for reeling of the web into the new reeling drum.

As shown in FIG. 4, the new, pre-accelerated reeling drum 22 is lowered onto the rails 10. The exchange of the web from the jumbo roll to the new reeling drum is carried out by means of normal prior art methods. The new reeling drum 22 has been brought into contact with the cylinder 15, and the new reeling drum revolves at the web speed in the direction indicated by the arrow S3. The support device 40 and cylinder 41 are in contact with the new reeling drum 22. The full jumbo roll continues to revolve in its exchange position in the direction indicated by the arrow S2, in engagement with the center drive 44 and the transfer device 45. By means of the cylinder 41 or equivalent, the reeling drum 22 is pressed/locked with such a force that the reeling drum 22 is not detached, and the friction force between the rolls 48, 47 or friction faces or equivalent and the face of the reeling drum 22 prevents vibrations of the reeling drum 22 during reeling.

Figure 5:
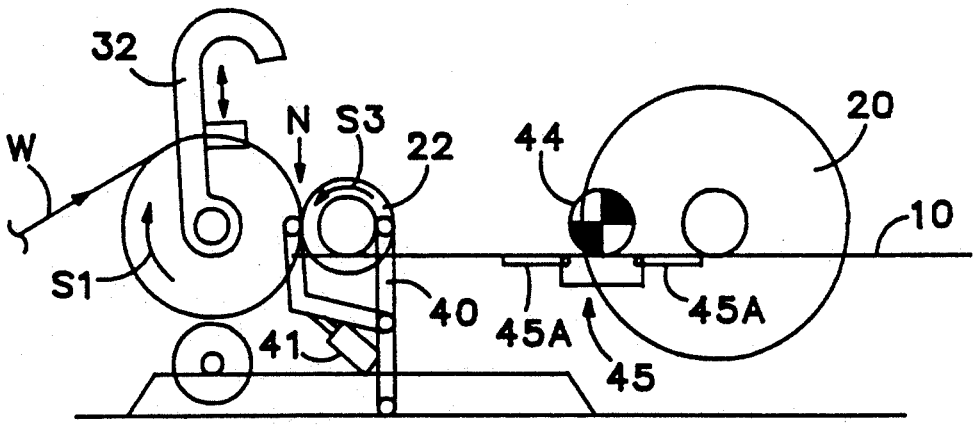
FIG. 5 is a schematic illustration of the reeling arrangement at the stage at which the full jumbo roll is slowed down and the transfer device and the center drive are shifted to the new reeling drum.

As shown in FIG. 5, the full jumbo roll 20 is slowed down by means of the center drive 44. The reeling-drum transfer device 45 is brought to the new reeling drum 22, and the center drive 44 is transferred to the new reeling drum 22. The auxiliary forks 32, i.e. the transfer members, have been returned to their initial position. The arms 45A of the transfer device 45 have been folded down below the level of the upper surfaces of the rails 10 to allow the transfer device to be shifted back to the reeling position. Reeling of the web onto the new reeling drum has been started, and therefore the new reeling drum is shown slightly larger in FIG. 5 than in FIGS. 1–4. The transfer device 45 and the center drive 44 are returned to the new reeling drum 22 for the next exchange.

At the stages shown in FIGS. 2–4, the press roll 35 has been employed to prevent access of air into the jumbo roll 20. By means of the press roll 35, it is also possible to act upon the structure of the jumbo roll 20. The press roll 35 is brought into contact with the jumbo roll before the jumbo roll 20 is separated from the reeling cylinder 15.

Figure 6:
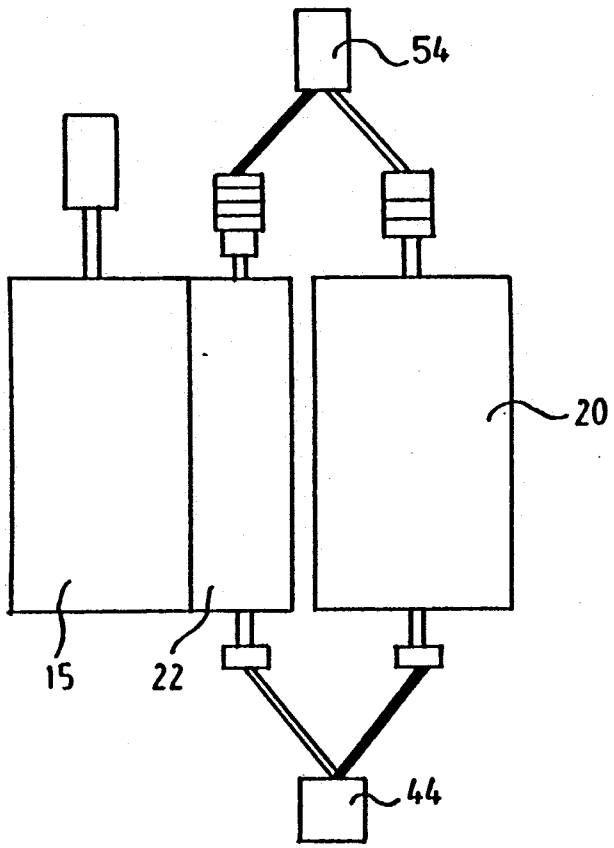
FIG. 6 is a schematic illustration of a reeling arrangement in accordance with the invention and in which two center drives are employed.

According to FIG. 6, it is possible to employ two center drives 44, 54, for example one drive at each side of the reeling arrangement, in which case it is not necessary to engage the drive in the middle of the reeling. The necessary nip load can be provided by means of the support device 40 and the cylinder 41, which already have a loading contact before the exchange (FIG. 4). The full jumbo roll 20 is controlled by the transfer device 45.

Figure 7:
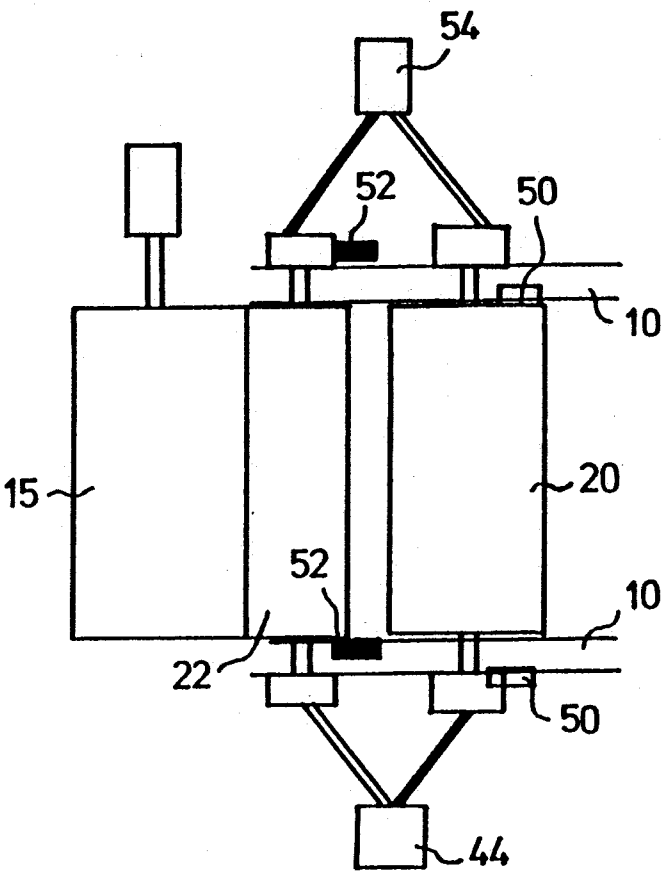
FIG. 7 is a schematic illustration of a reeling arrangement in accordance with the invention and in which two center drives and two support and transfer devices are employed.

As shown in FIG. 7, the full jumbo roll 20 in engagement with the first center drive 44 has been transferred by means of the first transfer and support devices 50, e.g. the first reeling forks, to the exchange position. The new reeling drum 22 is in engagement with the second center drive 54, and its support and transfer from the beginning of the reeling right to the end is taken care of by the second support and transfer device 52, e.g. the second reeling forks. The support and transfer devices 50 of the full jumbo roll 20 are brought to the new reeling drum, and the center drive 44 is engaged with the new reel in drum after the preceding new reeling drum 22 is full and has been transferred to the exchange position by means of the support and transfer device 52. The necessary nip loading can be provided by means of the support and transfer devices 50, 52. The full jumbo roll 20 is controlled by the first support and transfer devices 50, and the second support and transfer devices 52 take care of the support and control of the new reeling drum 22 that is currently being reeled. The support and transfer devices 50, 52 preferably consist of reeling forks, which are fitted in the reel-up arrangement so that, in the first support and transfer devices 50, one fork at one end of the reeling drum is placed inside the rail 10, whereas the other fork at the opposite end of the reeling drum is placed outside the other rail 10, and in the second support and transfer devices 52, the forks are at opposite sides of the rails 10, as shown in FIG. 7. Then the two pairs of reeling forks can reciprocate along the rails 10 without interfering with each other.

As shown in FIG. 7, the first support and transfer devices 50 and the second support and transfer devices 52 alternate in being engaged with the new reeling drum 22 and taking care of the support and transfer of the reeling drum from the beginning of the reeling to the end without exchange. In the exemplifying embodiment of FIG. 7, two center drives 44, 54 are also employed.

Above, the invention has been described with reference to some of its preferred exemplifying embodiments alone. This is, however, not supposed to confine the invention to these embodiments alone, but many variations and modifications are possible within the scope of the invention defined in the following claims.

I claim:

1. A reel-up comprising:

a reeling cylinder, means for supporting a reeling drum in a reeling position relative to the reeling cylinder so that the reeling cylinder and reeling drum form a nip for receiving a web being reeled onto said reeling drum, a first support and transfer device for supporting a first reeling drum at the reeling position and for transferring the first reeling drum to an exchange position, and a second support and transfer device for receiving a second reeling drum when the first reeling drum is at the exchange position and delivering the second reeling drum to the reeling position, wherein the first support and transfer device comprises a first pair of forks, the two forks of the first pair being at opposite respective sides of the reel-up, and the second support and transfer device comprises a second pair of forks, the two forks of the second pair being at opposite respective sides of the reel-up, and the two forks at each side of the reel-up are spaced apart from each other in a direction parallel to the central axis of the reeling cylinder, whereby one pair of forks can be used to transfer a reeling drum from the reeling position to the exchange position and the other pair of forks can be returned from the exchange position to the reeling position without interfering with each other.

2. A reel-up according to claim 1, comprising a center drive at one side of the reel-up for connection to a first reeling drum and a second center drive at the opposite side of the reel-up for connection to a second reeling drum.

3. A reel-up according to claim 1, comprising at least one center drive for connection first to a first reeling drum and then to a second reeling drum.

* * * * *